US011253034B2

(12) United States Patent
Malavazos et al.

(10) Patent No.: US 11,253,034 B2
(45) Date of Patent: Feb. 22, 2022

(54) SURVIVOR PACKAGE

(71) Applicants: Alex Malavazos, Truckee, CA (US); Gregory Malavazos, Carson City, NV (US)

(72) Inventors: Alex Malavazos, Truckee, CA (US); Gregory Malavazos, Carson City, NV (US)

( * ) Notice: Subject to any disclaimer, the term of this patent is extended or adjusted under 35 U.S.C. 154(b) by 650 days.

(21) Appl. No.: 15/646,910

(22) Filed: Jul. 11, 2017

(65) Prior Publication Data

US 2018/0125187 A1 May 10, 2018

Related U.S. Application Data

(60) Provisional application No. 62/493,599, filed on Jul. 11, 2016.

(51) Int. Cl.

| | |
|---|---|
| ***A45C 5/14*** | (2006.01) |
| ***A45C 15/00*** | (2006.01) |
| ***A45F 3/04*** | (2006.01) |
| ***A45F 4/04*** | (2006.01) |
| ***A45C 5/03*** | (2006.01) |
| ***A45C 15/04*** | (2006.01) |

(52) U.S. Cl.

CPC ..... *A45C 5/146* (2013.01); *A45C 5/03* (2013.01); *A45C 15/00* (2013.01); *A45C 15/04* (2013.01); *A45F 3/04* (2013.01); *A45F 4/04* (2013.01); *A45C 2005/037* (2013.01); *A45C 2005/148* (2013.01); *A45C 2200/15* (2013.01)

(58) Field of Classification Search

CPC ..... A45C 2007/004; A45C 2009/002; A45F 4/04

See application file for complete search history.

(56) References Cited

U.S. PATENT DOCUMENTS

| | | | | |
|---|---|---|---|---|
| 2,531,501 | A * | 11/1950 | Cline | A45C 3/10 135/133 |
| 2,671,623 | A | 3/1954 | Toulmin, Jr. | |
| 3,144,014 | A | 8/1964 | Mantell, Jr. | |
| 4,130,106 | A | 12/1978 | Clevett et al. | |
| 4,612,914 | A | 9/1986 | Dogey | |
| 4,947,498 | A * | 8/1990 | Van Boxtel | A45F 4/06 224/155 |
| 5,644,294 | A | 7/1997 | Ness | |
| 5,941,264 | A * | 8/1999 | Gregg | E04H 15/38 135/116 |
| 6,081,943 | A | 7/2000 | Garcete | |

(Continued)

FOREIGN PATENT DOCUMENTS

| | | | | |
|---|---|---|---|---|
| DE | 202018005048 U1 * | 3/2019 | | A45F 4/04 |
| FR | 2819156 A1 * | 7/2002 | | B60B 33/0015 |

*Primary Examiner* — Allan D Stevens

(74) *Attorney, Agent, or Firm* — Ian Burns; ATIP Law

(57) ABSTRACT

A survival package includes a casing having first and second compartments storing survival items including a tent and tent pole. The casing can be delivered to a recipient in a closed configuration. When opened, the first and second compartments lie adjacent each other and form a platform. The tent shelter may be fitted to the platform to form a tent shelter, using the tent pole to support the tent. A life jacket may be attached to the casing and may be used to extend the platform as well as provided a means for carrying the casing as a backpack.

18 Claims, 20 Drawing Sheets

(56) References Cited

U.S. PATENT DOCUMENTS

| | | | | |
|---|---|---|---|---|
| 6,289,554 | B1 * | 9/2001 | Wang | A45C 5/146 16/18 B |
| 6,314,579 | B1 | 11/2001 | Marcon | |
| 7,565,968 | B2 | 7/2009 | Lindley | |
| 7,612,735 | B2 | 11/2009 | Essig, Jr. et al. | |
| 8,593,102 | B2 | 11/2013 | McGuire et al. | |
| 8,641,056 | B1 | 2/2014 | Carter | |
| 9,027,721 | B1 | 5/2015 | Osborne | |
| 9,241,849 | B1 | 1/2016 | Caskey | |
| 9,426,978 | B1 * | 8/2016 | Galloway | A01M 31/025 |
| 2006/0289001 | A1 | 12/2006 | Hopewell | |
| 2008/0236972 | A1 | 10/2008 | Lee et al. | |
| 2008/0314947 | A1 | 12/2008 | Gold et al. | |
| 2012/0222931 | A1 * | 9/2012 | Zuckerman | A45C 5/03 190/2 |
| 2013/0228600 | A1 * | 9/2013 | Teixeira | A45F 4/08 224/156 |
| 2013/0284553 | A1 * | 10/2013 | Daniels | A45C 5/14 190/18 A |
| 2014/0077467 | A1 * | 3/2014 | Galante | B62B 1/12 280/35 |
| 2014/0216511 | A1 | 8/2014 | Brown et al. | |
| 2015/0257500 | A1 * | 9/2015 | Carter | A47D 5/006 150/106 |
| 2016/0015157 | A1 | 1/2016 | Nouri | |

* cited by examiner 13
4
9
6
35
5
10
8
17
25
62

SURVIVOR PACKAGE

CROSS REFERENCE TO RELATED APPLICATIONS

This application claims priority to U.S. provisional patent application Ser. No. 62/493,599 filed Jul. 11, 2016, the contents of which are herein incorporated by reference.

FIELD OF THE INVENTION

The present invention relates to a package that can store basic life saving supplies that can be reached and utilized in a timely, efficiently and orderly manner.

BACKGROUND

Historically, disasters kill millions of people and cause billions of dollars of damage each year. When disasters strikes, communications and transportation systems fail or are usually greatly degraded. Agencies, organizations and churches try to supply and distribute water, blankets, food and the most basic of life's essentials items to those in need when located. Unfortunately, most communities and individuals are not prepared for these catastrophes and time is of the essence. Many times, the items needed to save lives and reduce suffering are done on a piecemeal basis, with those in need not receiving everything required at one time, in one place or in a timely manner. Additionally, even if survival supplies are provided, most people can't readily carry supplies easily, if at all. Shelter is usually not available to the masses of people and people are exposed to the various elements day and night for an indeterminate period of time. This has caused additional anxiety, stress, confusion, and even death, to an already chaotic disaster situation.

Current disaster kits, supplies and literature which are typically available for only 72 hours use fall way short of being comprehensive, light weight, versatile and all inclusive package that can be distributed all at once.

What is required is an improved survival package.

SUMMARY OF ONE OR MORE EMBODIMENTS OF THE INVENTION

Advantages of One or More Embodiments of the Present Invention

The various embodiments of the present invention may, but do not necessarily, achieve one or more of the following advantages:

provide a comprehensive survival package;

provide a survival package that can be used for extended periods of time;

provide an emergency shelter;

provide a platform and cover for sleeping;

provide a mobile survival package;

provide a survival package with life jacket or vest;

provide a means for carrying a survival package;

provide a survival package with an emergency toilet configuration;

provide a survival package with a removable handle that provides one or more tools; and provide a survival package with wheels that can be retracted or folded when not required.

These and other advantages may be realized by reference to the remaining portions of the specification, claims, and abstract.

BRIEF DESCRIPTION OF ONE OR MORE EMBODIMENTS OF THE PRESENT INVENTION

In one embodiment, there is provided a survival package. The package includes a casing comprising first and second compartments. The casing can be opened such that the compartments lie adjacent each other and form a platform. A tent may be stored in at least one of the compartments. The tent may be removed from its storage compartment and fitted to the platform to create a tent shelter.

In one embodiment, there is provided a survival package comprising first compartment means for storing one or more first items; and second compartment means for storing one or more second items. Tent means is provided for providing a tent shelter. The second compartment means may be joined to the first compartment means to form casing means that may be transportable. The casing means may be opened such that the first compartment means and second compartment means can be located adjacent each other to form platform means. The tent means may be fitted to the platform means to form tent shelter means for sheltering a person.

The above description sets forth, rather broadly, a summary of one embodiment of the present invention so that the detailed description that follows may be better understood and contributions of the present invention to the art may be better appreciated. Some of the embodiments of the present invention may not include all of the features or characteristics listed in the above summary. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF CERTAIN EMBODIMENTS OF THE PRESENT INVENTION

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

A survival package in accordance with an embodiment of the present invention provides many of the essential life saving items in one package, in one place which can be easily transported. In addition, the package also provides an easier way of transporting the injured and disabled to a safer place. In various embodiments, the invention may provide mobile-health devices, (wireless cell phone) with special disaster/emergency mobile-heath software applications so users can communicate, receive disaster information, access and provide their own personal data, report current location situation/conditions to others (if need be). The communications capabilities may thus allow disaster survivors to become more self reliant, able to help others and not become just passive disaster victims waiting for rescue.

The survival package units may be mass transported by land, sea and air and dropped by aircraft, as necessary as the fastest distribution system, for getting all the life saving essential survival items to an individual at one time in one uniform package of products. It provides users with better and more disaster product items, more features and functions. Thus it greatly reduces the cost and time to: plan, manufacture, and ship the units and also to manage and train disaster personnel and users. With a survival package as to be more fully described herein, disaster survivors can receive their own personal unit which they alone can control and transport.

The present invention is directed to overcoming one or more of the problems discussed above while saving more lives and reducing human suffering due to disasters.

Figure 1A:
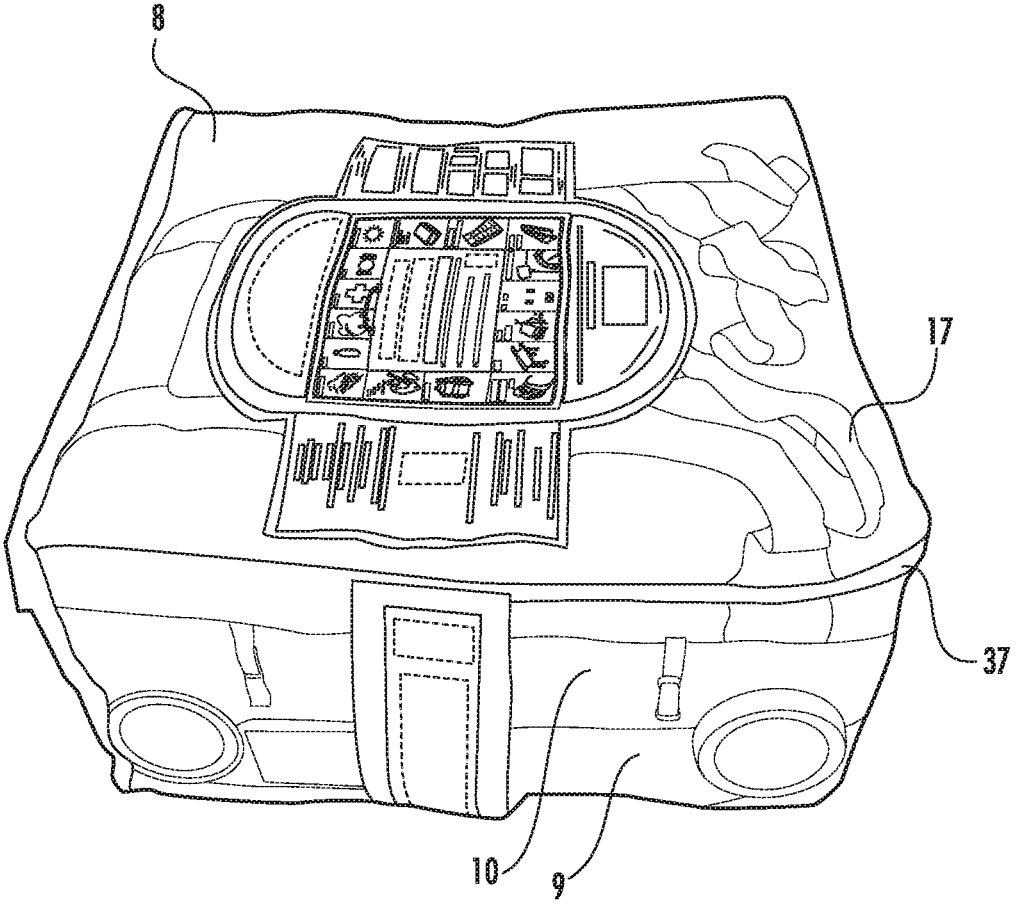
FIG. 1A is substantially a view of a survival package casing in a closed position.

Referring initially to FIG. 1A a survival package unit in the form of a bi-fold case is depicted in a closed state as it would be distributed to a recipient. The case, made of compartment A (9) and compartment B (10), lifejacket/backpack vest (8), and enclosed bivy tent is bright in color with photo luminescent material so it can be easily be seen glowing in the dark. The compartment A (9) and compartment B (10) is designed with ribs built in, to provide strength, rigidity and integrity while reducing weight. This design provides protection to the contents while allowing the units to be durable and stacked for shipping. The case may be formed of any suitable material, including a variety of plastics as will be apparent to the person skilled in the art.

A clear plastic stuff bag, (37), is used for shipment purposes to protect the lifejacket/backpack-vest (8), as extra storage capacity when removed from the case, and provides advertisement space for printed material. Straps (17) may be used to transport unit as a backpack.

Figures 1B, 1C, 1D:
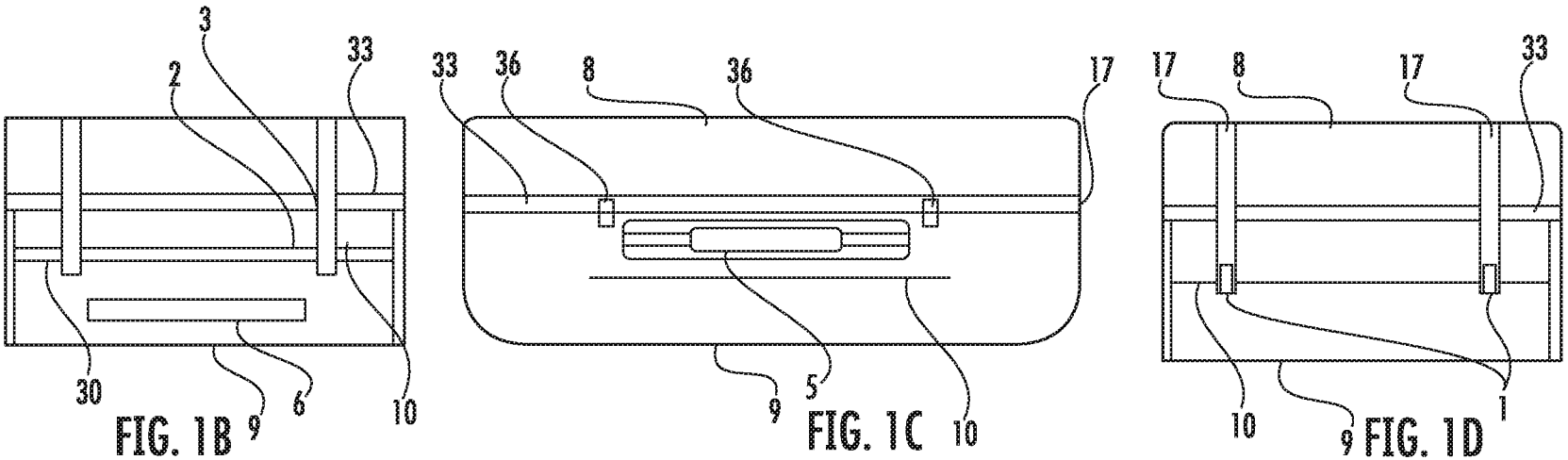
FIGS. 1B, 1C & 1D are substantially perspective views of the left, center, and right side of the casing respectively.

FIGS. 1B, C & D are perspective views of the left, center, right side of the case, lifejacket/backpack-vest and associated hardware components. The case sections, compartment A (9) and compartment B (10) are held together at one end with a continuous detachable hinge (30). As shown in the figures, the case is generally rectangular and the hinge 30 is provided on a short edge of the case. The use of the hinge on the short edge of the case means that when the case is unfolded, the case will provide a longer platform than if the more conventional long edge of the case was hinged. The platform functionality of the case will be described in more detail below.

The hinge may be a conventional metal, plastic, fabric hinge, though the specific form of the connection between the compartment A (9) and compartment B (10) is not pertinent to the present invention. Other connection mechanisms will be apparent to the person skilled in the art. Furthermore, as discussed in more detail below, in various embodiments, it is not essential for the compartments to be permanently connected and thus for such embodiments, compartment A (9) may be temporarily joined to compartment B (10) by various alternative forms including straps, latches, etc.

There are two water resistant seals (2) & (3) which allows the case to be water resistant to protect the contents of compartment A & B. One seal (2) is between compartment A (9) and compartment B (10). The second seal (3) is between compartment B (10) and its top cover lid (33). Pull cart handle (6) is shown in the retracted and closed position in compartment A (9).

FIG. 1C shows the wheels (4), handle (5) the detachable locking latches (36) which allows the top cover lid (33) to be opened and locked closed to compartment B (10). The lifejacket/backpack-vest (8) is attached to compartment A (9) by lifejacket/backpack-vest straps (17) and can be removed and used separately at any time.

FIG. 1D shows the detachable locking latches (1) that allow compartment B (10) to become completely detached from compartment A (9) and carried separately, when compartment A (9) is not required. Lifejacket/backpack-vest (8) is attached compartment A (9).

Figure 2:
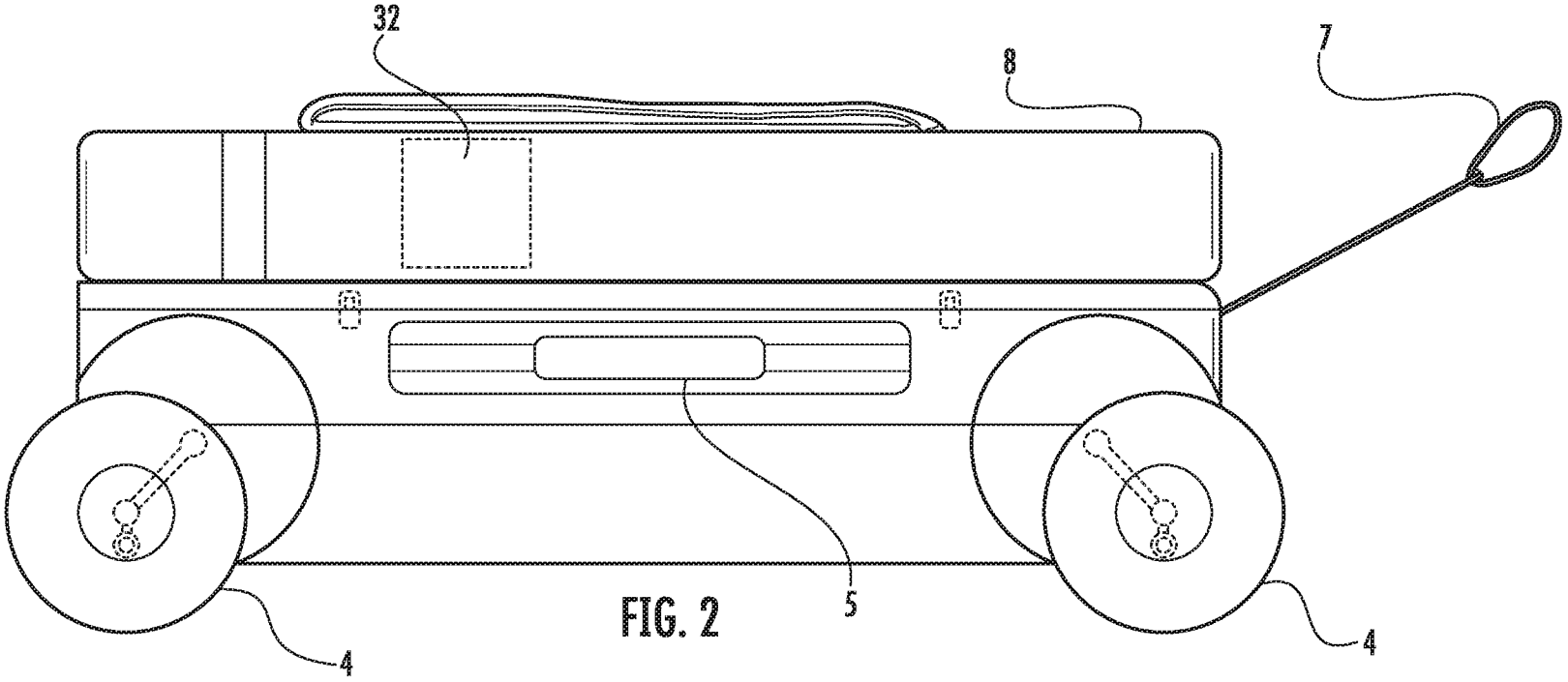
FIG. 2 is substantially a perspective of the case in a closed state with the carry handle in an extended position.

FIG. 2 is a perspective of the case of the invention in a closed state with the handle (5), lifejacket/backpack-vest (8), with the wheels (4) and pull strap (7) in an extended position for transport movement if used as a pull cart. Emergency Mess Container (32) is attached to and stored in lifejacket/backpack-vest (8).

Figure 3A:
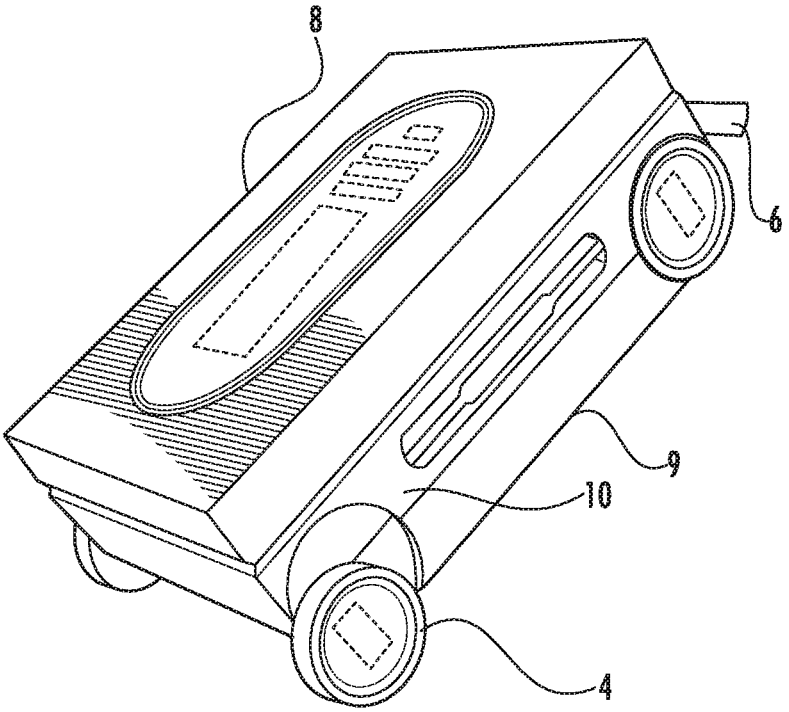
FIGS. 3A & 3B are substantially top perspective and bottom perspective views respectively showing the case in a wheeled transport configuration.
Figure 3B:
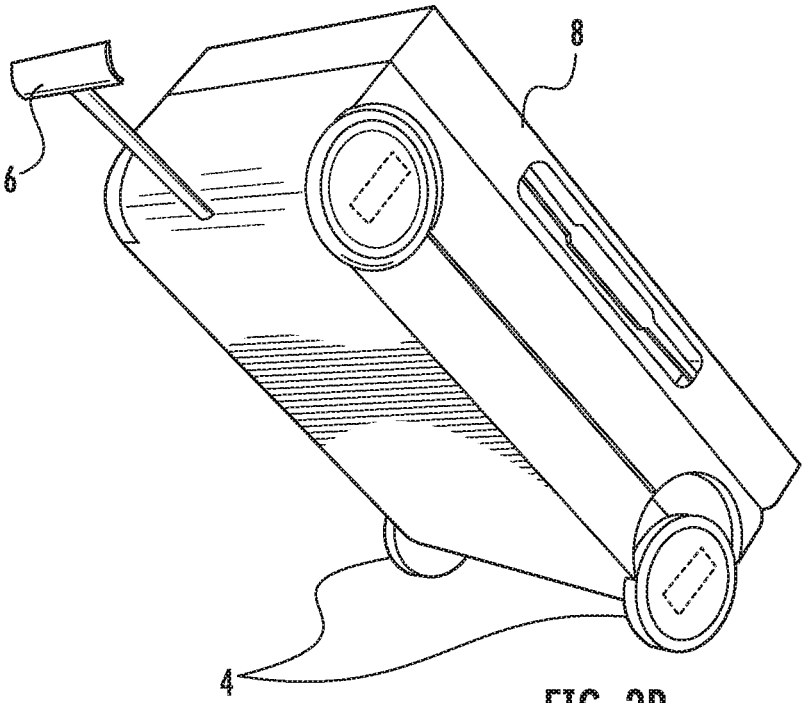

FIGS. 3A & 3B is top, bottom and side views of the case configured with lifejacket/backpack-vest (8) on the top of the compartment A (9) and compartment B (10) as a pull cart showing two of the four wheels (4) and the pull cart handle (6) with saw/knife combination tool (62) in the extended and open position, used as a pull handle.

Figure 4:
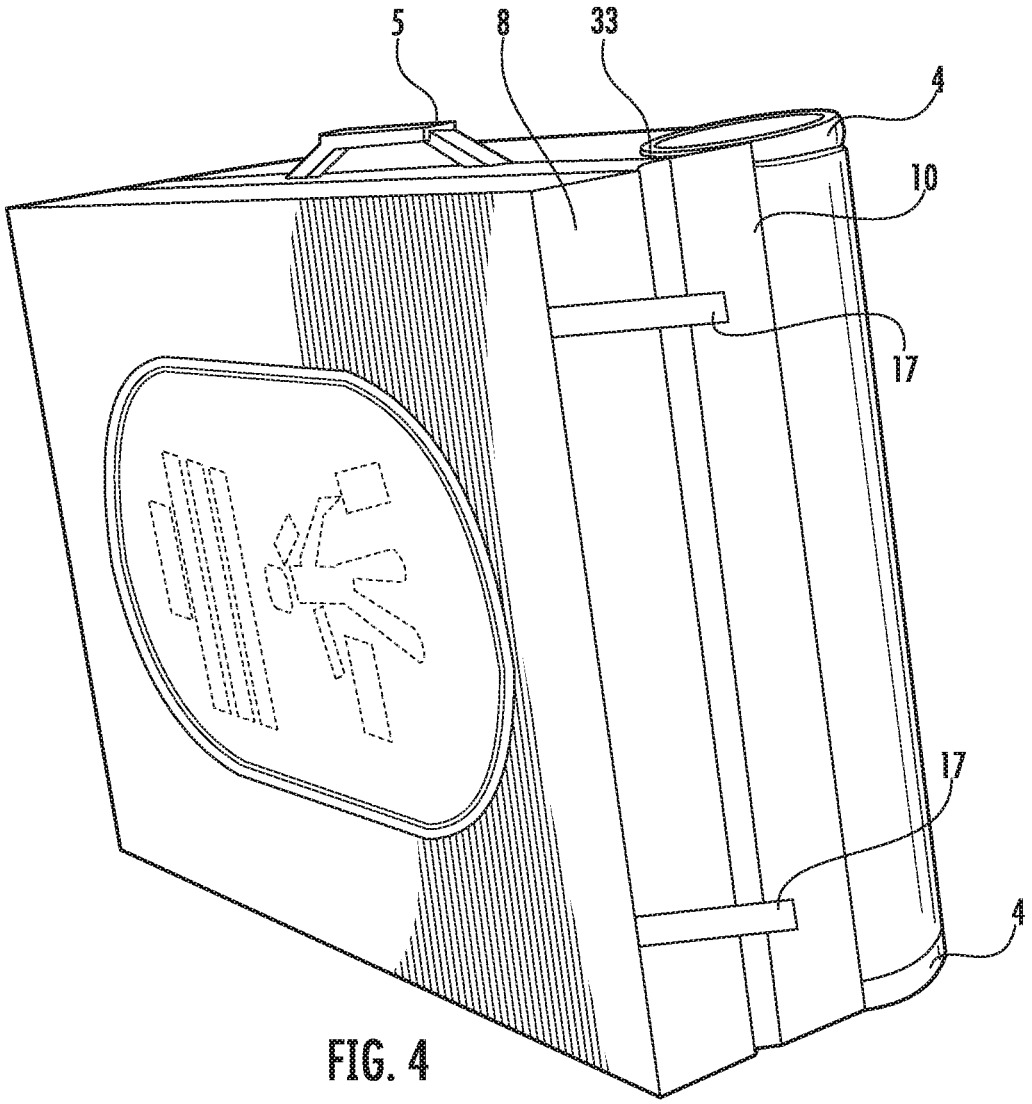
FIG. 4 substantially shows the case configured as a carry case for transportation.

FIG. 4 shows the case configured as a carry case for transportation. This view shows only the handle (5) in the open and extended position for transportation of the case. All other handles, straps and wheels (4) are in the closed or retracted position. The lifejacket/backpack-vest (8) is attached to compartment A (9) by lifejacket/backpack-vest straps (17).

Figure 5A:
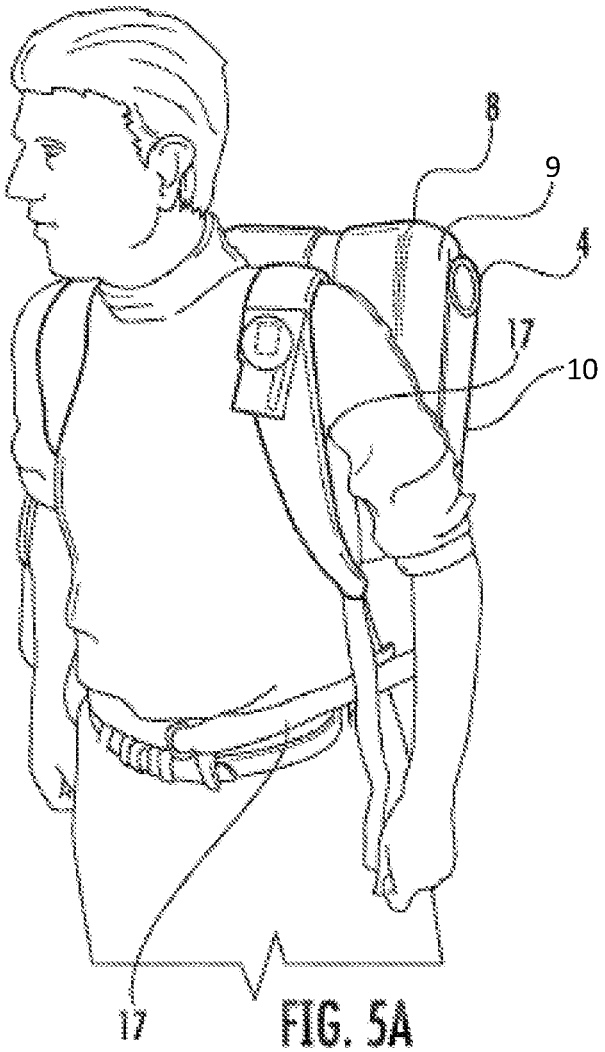
FIGS. 5A & 5B are substantially front and rear views respectively showing the case being carried as a backpack.
Figure 5B:
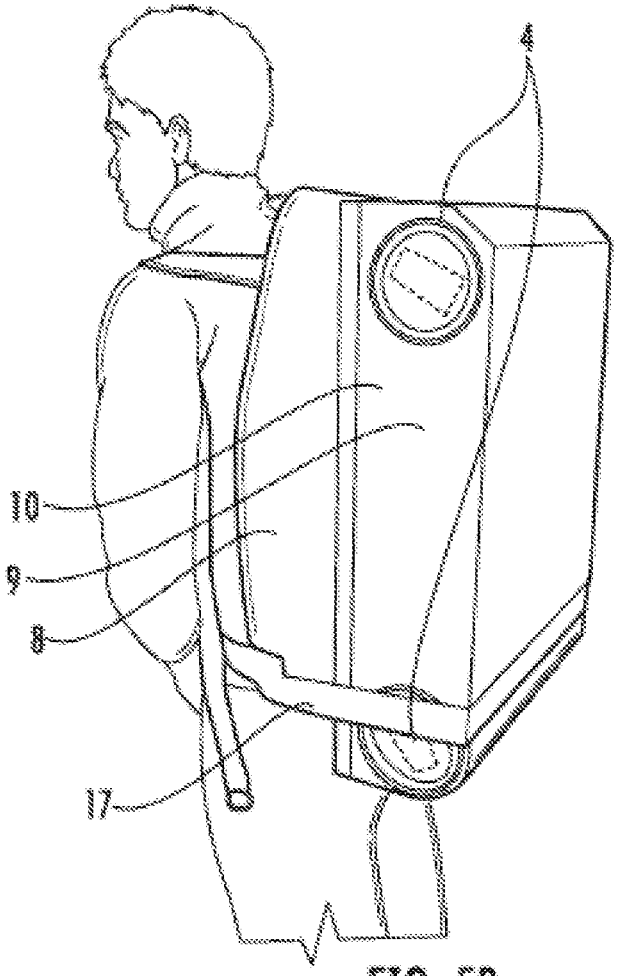

FIGS. 5A & 5B are views of the lifejacket/backpack-vest (8) carried as a backpack. FIG. 5A shows a front view of an adult person transporting the unit as a lifejacket/backpack-vest (8). The lifejacket/backpack-vest (8) is shown physically attached to compartment A (9) and the straps (17) that go completely around the compartment A (9) and compartment B (10) which secure the case to the users back and shoulders while in transit. The wheels (4) handle (5), and pull cart handle (6) are retracted.

FIG. 5B shows a side view of an adult person transporting the unit as a lifejacket/backpack-vest (8) and straps (17) are shown physically attached to compartment (9) and the straps (17) that go completely around the compartment A (9) and compartment B (10) which secure the cases to the users back and shoulders while in transit. The wheels (4), and pull cart handle (6) are retracted.

Figure 6A:
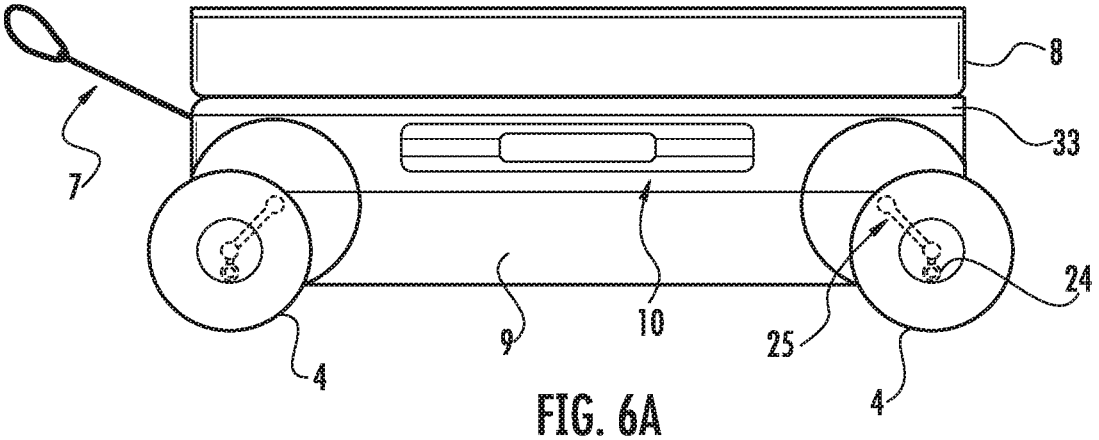
FIG. 6A is substantially a side view of the case showing a sliding wheel arrangement.
Figure 6B:
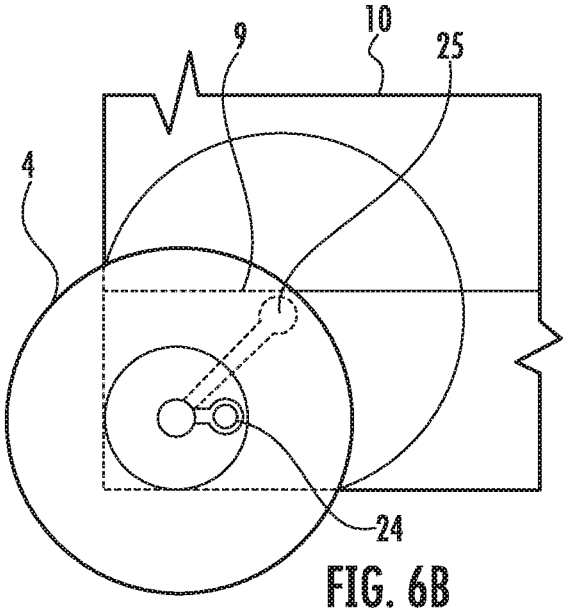
FIG. 6B is a close up view of the wheel arrangement of FIG. 6A.
Figure 6C:
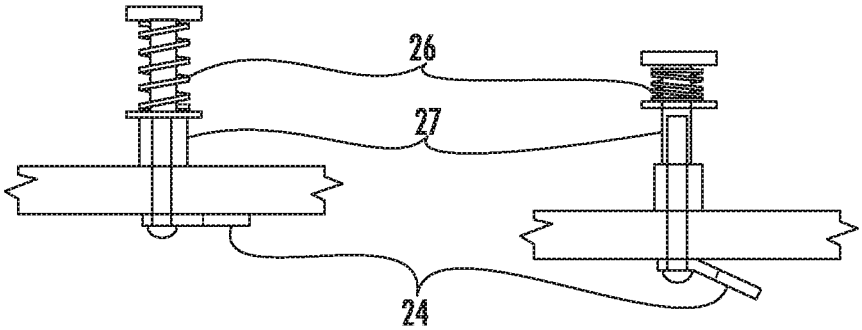
FIG. 6C is substantially a top view of the wheel arrangement of FIG. 6B showing the method of operation.

FIGS. 6A and 6B and 6C show how the unit is configured to be a pull cart. In FIG. 6A the case is configured as a pull cart with the wheels (4) and pull strap (7) in the extended position; the Lifejacket/backpack-vest (8) is attached on top of compartment (9) & (10).

FIG. 6B shows the spring locking mechanism which allows the wheels to extend and lock into place via wheel slot (25). FIG. 6C shows when the wheel tab (24) is pulled, the spring (26) is compressed on the stepped shaft (27) which unlocks the wheel. This allows the smaller diameter portion of the stepped shaft (27) to move diagonally up and down in the wheel slot (25) located on compartment A (9). This in turn allows the wheels to retract and lock when the spring is extended which lets the larger diameter portion of the stepped shaft (27) to seat itself into the larger opening of the wheel slot (25).

Figure 7A:
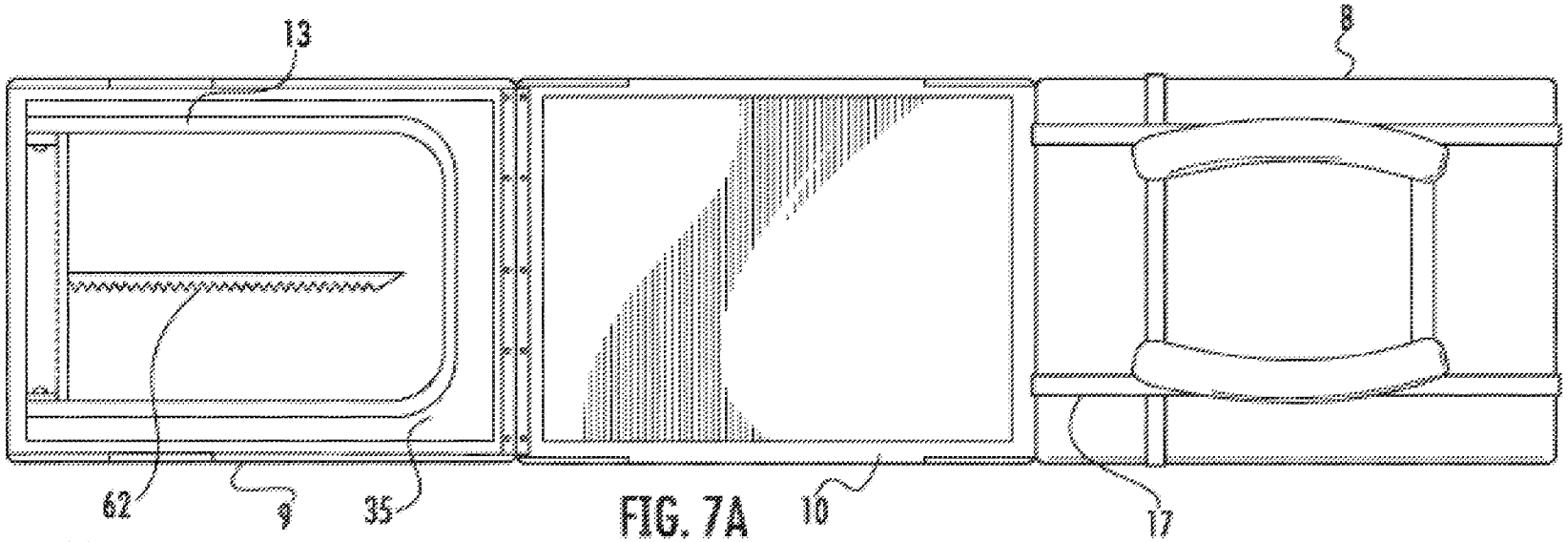
FIGS. 7A & 7B are substantially top and side views respectively showing the casing configured as a platform.
Figure 7B:
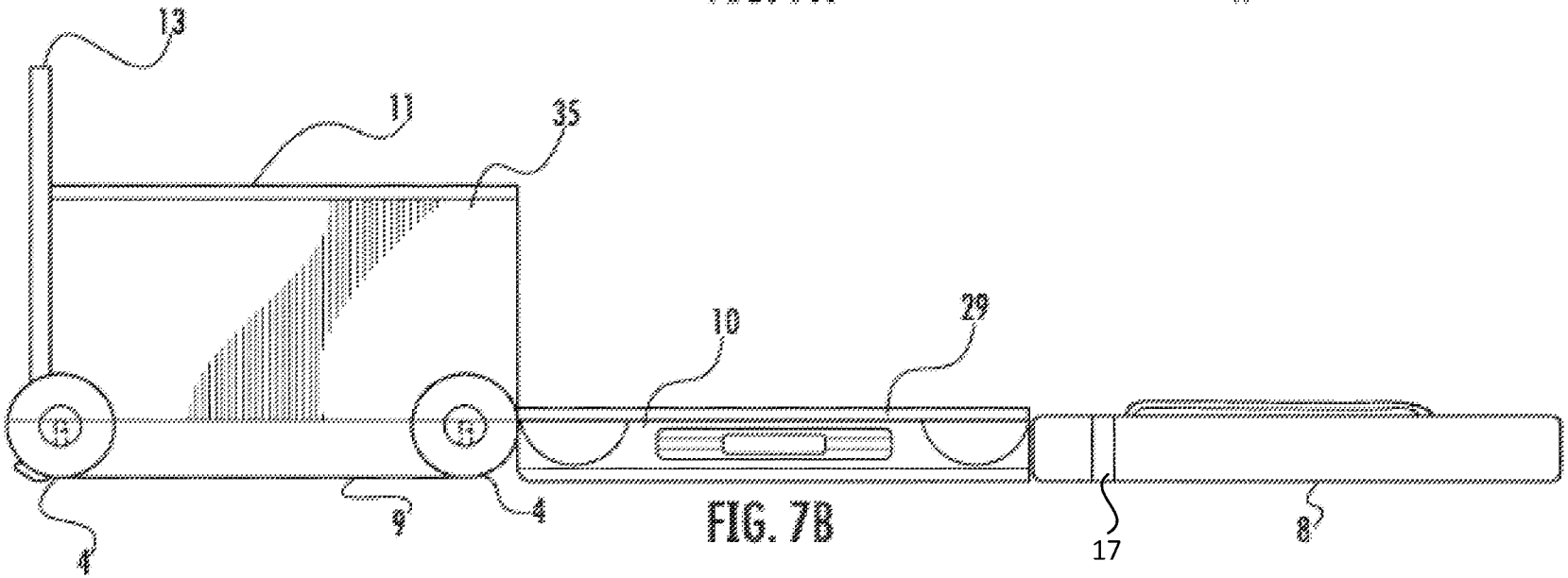

FIGS. 7A and 7B are views of the bi-fold case in an open extended position. In FIG. 7B the case is open, and head bow or tent pole (13) down in compartment A (9) lid (35) provides access where bivy tent and supplies are stored and when closed can be used as the bivy tent platform.

FIG. 7A this is a view of the case with the lid (35) in the open position showing where the bivy tent and emergency items are stored for easy access. The pull cart handle (6) with saw/knife combination tool (62) is shown in the retracted closed position where it is stored when not in use.

The wheels (4) when not in use for transporting the case are shown in the retracted position. The lid (35) also serves as a surface in the closed position for the user to lie in a flat position, for off the ground sleeping protection and comfort. The compartment A (9) and compartment B (10) have padded lid surfaces (11) & (29) on them for sleeping comfort and weather insulation. The lifejacket/backpack-vest (8) is attached to compartment A (9) with lifejacket/backpack-vest straps (17) to allow for user to lay flat on compartment A (9) and compartment B (10) and lifejacket/backpack-vest (8), for off the ground comfort and protection bivy tent platform, when user are over 4 feet tall.

Figures 8A, 8B, 8C, 8D:
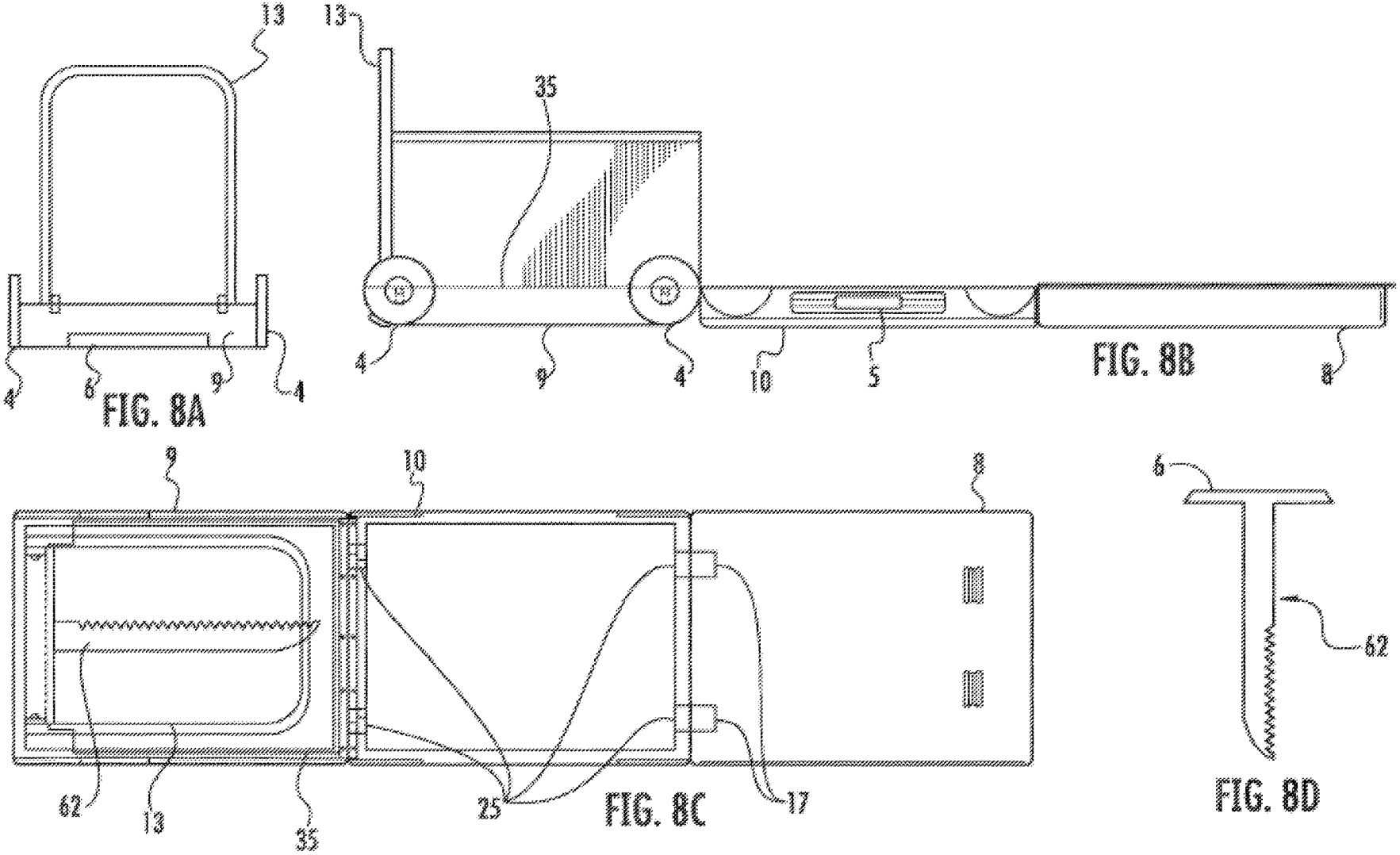
FIGS. 8A, 8B & 8C are substantially end, side and top views respectively showing the casing configured as a platform with a tent pole for supporting a tent shelter.
FIG. 8D substantially shows a handle with a saw tool.

FIG. 8A is a front view of the case without the bivy tent attached, with the head bow or tent pole (13), which supports the front portion of the bivy tent, when attached to the compartment A (9) in the up position.

The head bow may be a bent tubular section of metal, such as aluminum or the like, having two uprights sections, as depicted in FIG. 8A, and an upper cross member section between the two upright sections. At the lower end of the upright sections, the head bow (13) may be joined to the case by pivoting connections. Alternatively, sleeves may be provided for supporting the head bow in the upright position. In this embodiment, the head bow may be entirely removed from the case and supported by the sleeves. In a further alternative, the supporting sleeves may be replaced by supporting pins the extend inside the tubular ends of the head bow. While the head bow (13) has been described as a single piece tent pole, the person skilled in the art will appreciate that other forms of frame may be utilized. For example, the head bow may be a multi-piece pole and may be made of various materials including, without limitation, shock corded fiberglass, aluminum, etc.

FIG. 8A also shows the front wheels 4 in the up position and pull cart handle (6) with saw/knife combination tool (62) retracted into the compartment A (9) when not in use.

Referring to drawing FIG. 8B, this is a side view of the case without the bivy tent, showing the head bow (13) up, wheels (4) in the retracted up position, with the case open showing the two compartment A (9) and compartment B (10) extended to form the base platform, to keep the bivy tent shelter off the ground. The location for the lid (35) for compartment A (9) and top cover lid (33) for compartment B (10), handle (5).

Referring to drawing 8C, this is a top view of the case without the bivy tent attached showing the compartment A (9) and compartment B (10) and associated lifejacket/backpack-vest (8). The head bow (13) is shown in the down stored position along with the pull handle/saw/knife combination tool (6) when not in use and retracted into compartment A (9). Additionally, compartment B (10) has four strap anchors (28) built in to it, which are used to attach the combination lifejacket/backpack-vest straps (17) to the case when used to transport it as a backpack.

FIG. 8D shows pull handle/saw/knife combination tool when detached from compartment A (9) and used as a separate tool.

Figure 9A:
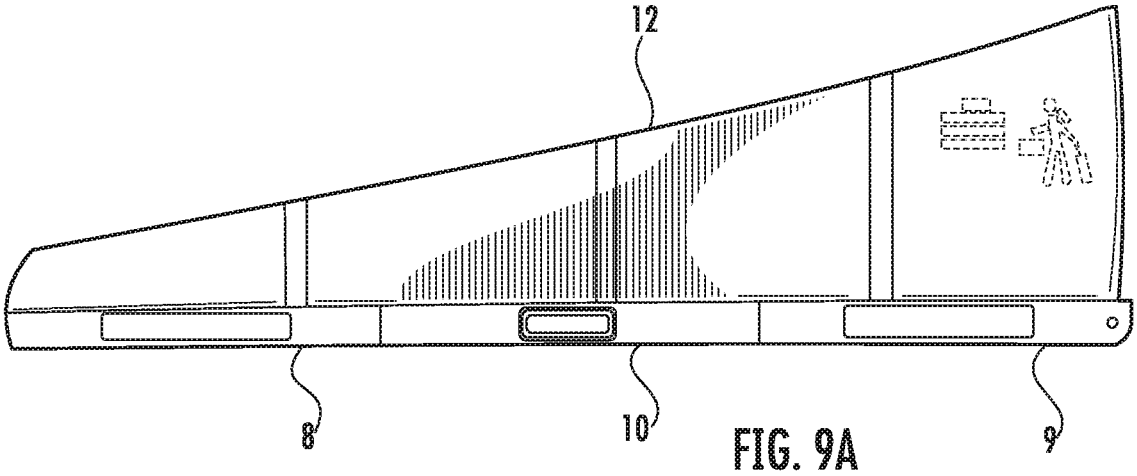
FIGS. 9A & 9B are substantially end and side views respectively showing the casing configured as a tent shelter.
Figure 9B:
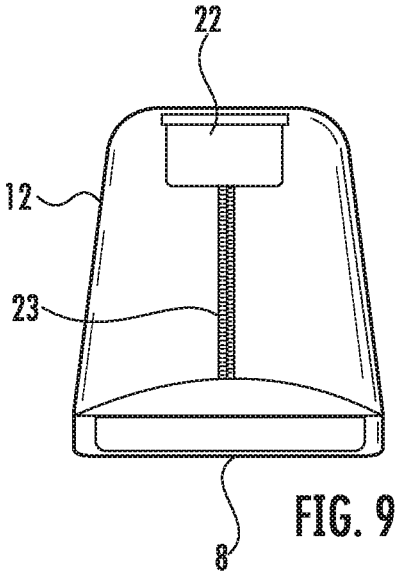

FIGS. 9A and 9B show the bivy tent attached to the base platform. Referring to FIG. 9A, this is a side view of the bivy tent (12) when the head bow is in the up position, stretched over the platform base made up of the two compartment A (9) and compartment B (10) and lifejacket/backpack-vest (8) which forms a shelter off the ground for comfort and protection. Referring to drawing 9B, this is a front view of the bivy showing the location of the platform, bivy tent (12), bivy tent zipper (23) for access, and the tent air flap (22) for ventilation.

Figure 10:
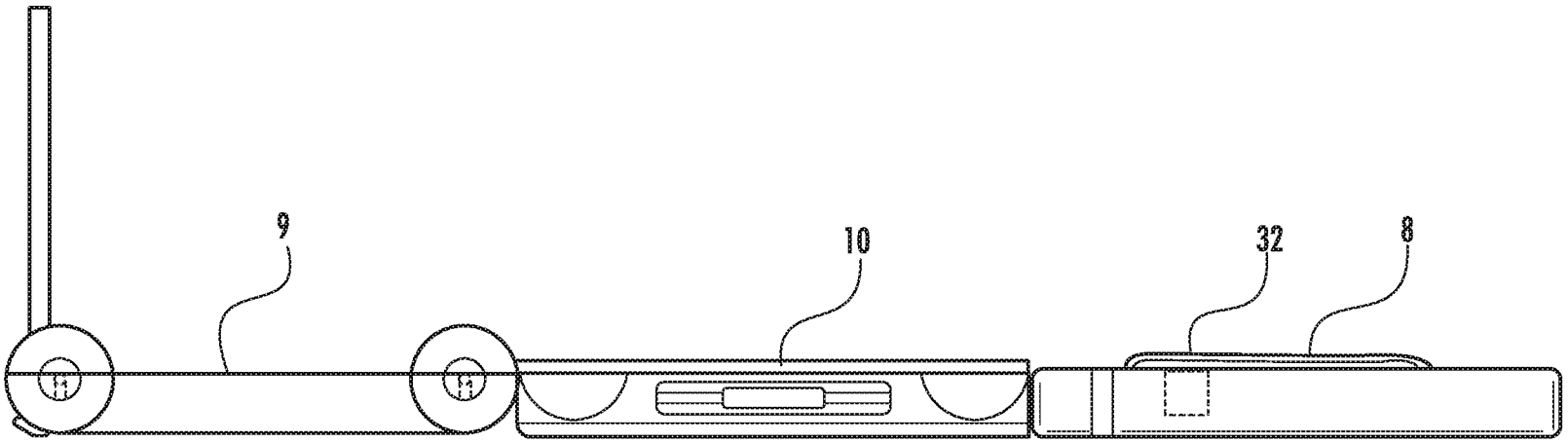
FIG. 10 substantially shows the storage compartments of the casing.

FIG. 10 is a view of the two compartment A (9) and compartment B (10). These compartments, when their respective lids are closed, form the base for the bivy tent platform. The bivy tent (12) may attach to compartment A (9) and compartment B (10) via suitable attachment methods such as studs, straps, zippers, hook and look fasteners, etc. In an alternative embodiment, the tent 12 may have no direct attachment to the platform and may be held in place by the weight of the platform and the occupant.

The bivy tent 12 may be made of any suitable material, including, without limitation, plastic, various breathable materials, coated plastics, fabrics, canvas, and the like which may provide sufficient waterproofing and/or breathability.

Compartment A (9) and compartment B (10) provide first and second storage sections respectively. The emergency items contained in each of these compartments are as follows:

Compartment A (9)—Bivy tent, head bow support, stuff bag/tent vent, combination pull handle/saw/knife tool.

Compartment B (10)—water packages, water purification tablets, water hydration containers, food bars, tea, sugar salt, chewing gum, Light Emitting Diode (LED) flash light/strobe, waterproof matches, 12 hr. light stick, fire sticks, candles, emergency stove, solar blanket, poncho, bandana, mirror, whistle, orange trail tape, compass pencil, note pad, Aid guide pamphlet, adhesive tape, sterile pads, bandages, elastic patch, antibiotic ointment, non-aspirin pain reliever, toilet paper, sanitation bags, survival booklet, and Bible.

Location C—combination lifejacket/backpack vest (8) and Emergency Mess Container (32).

Figure 11A:
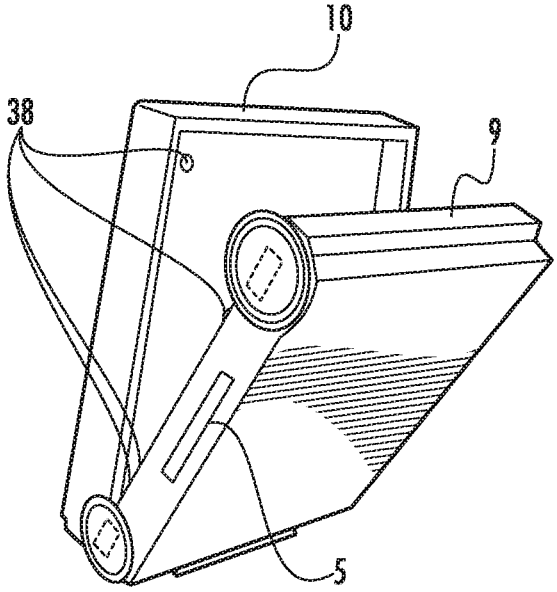
FIGS. 11A & 11B are substantially perspective side and end views showing the casing in an emergency toilet configuration.
Figure 11B:
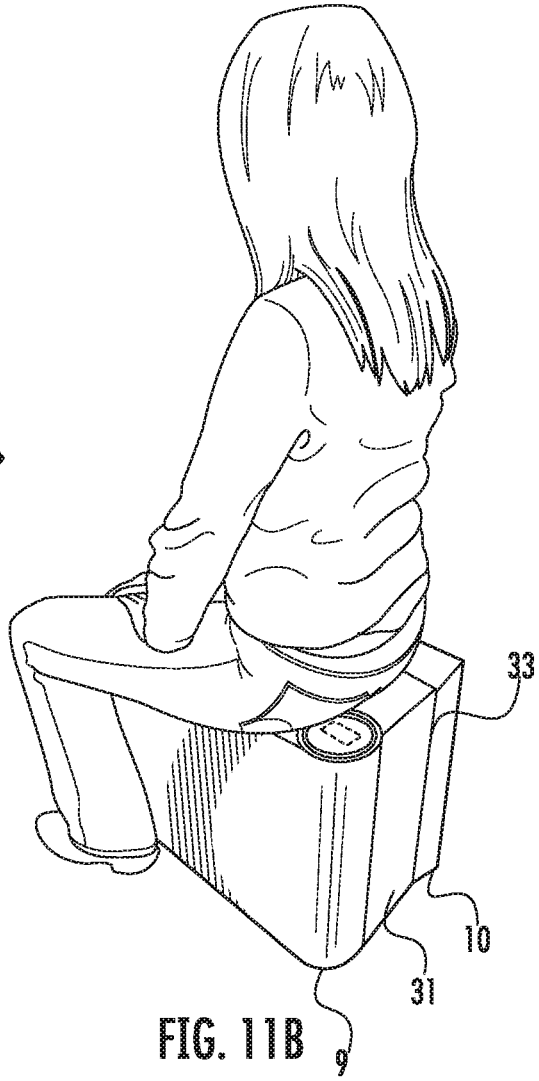

FIGS. 11A and 11B are views of the bi-fold case configured as a portable sanitation toilet. FIG. 11A is a view of the case standing on end, with the handle (5) side up, with compartment A (9) and compartment B (10) hinged apart on an angle to form a stable sitting surface.

Additionally, FIG. 11B is a top view of the sitting surface showing the compartment A (9) and compartment B (10) hinged apart forming the base sitting area. The disposable sanitation bag (31) is attached to compartment A (9) and compartment B (10) and held in place by snaps (38). The sanitation bag is thus able to collect human waste for removal for health reasons.

Figure 12A:
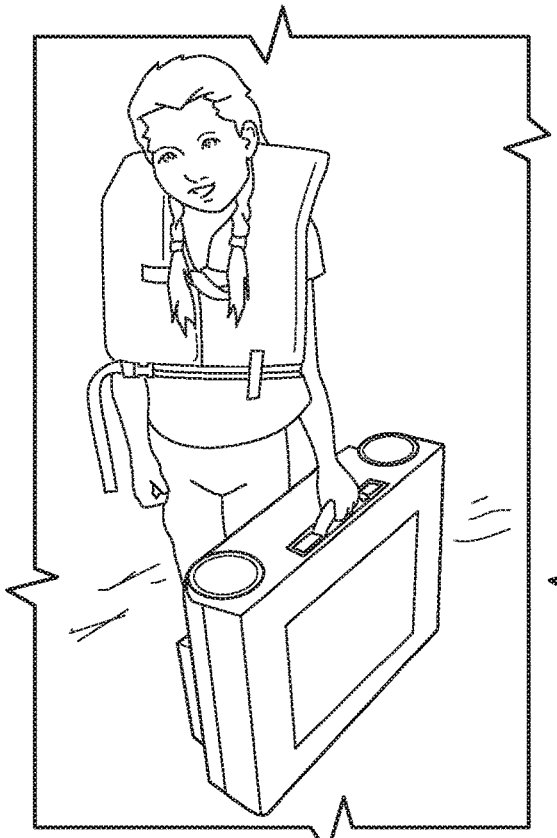
FIGS. 12A, 12B & 12C substantially show a child embodiment of the casing.
Figure 12B:
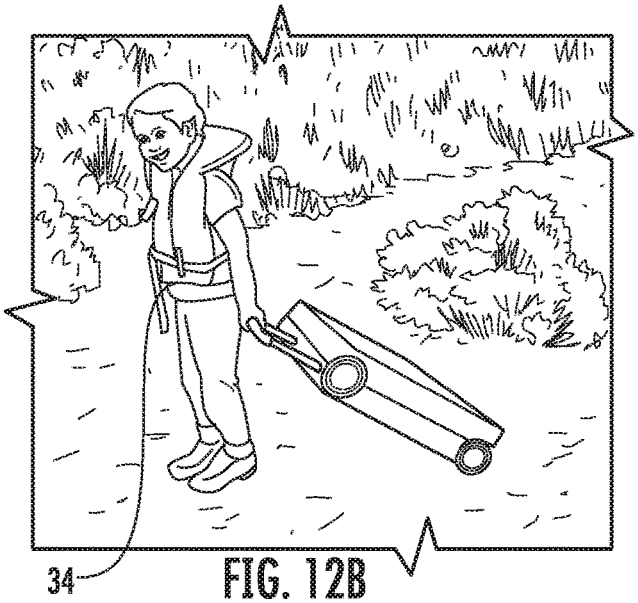
Figure 12C:
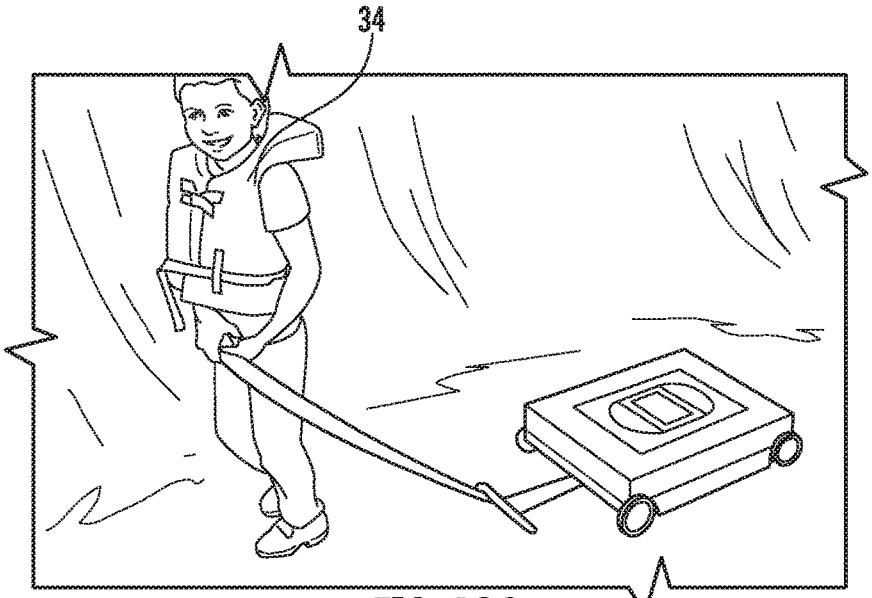

FIGS. 12A, 12B & 12C are views of the child version being transported as a carrying handle suite case, rolling cart and pull cart. Child lifejacket (34) is normally stored in compartment B (10) until required and the adult lifejacket (8) is omitted for the child version. Child version uses the adult compartment A (9) and compartment B (10) as shown in FIG. 1.

Figure 13:
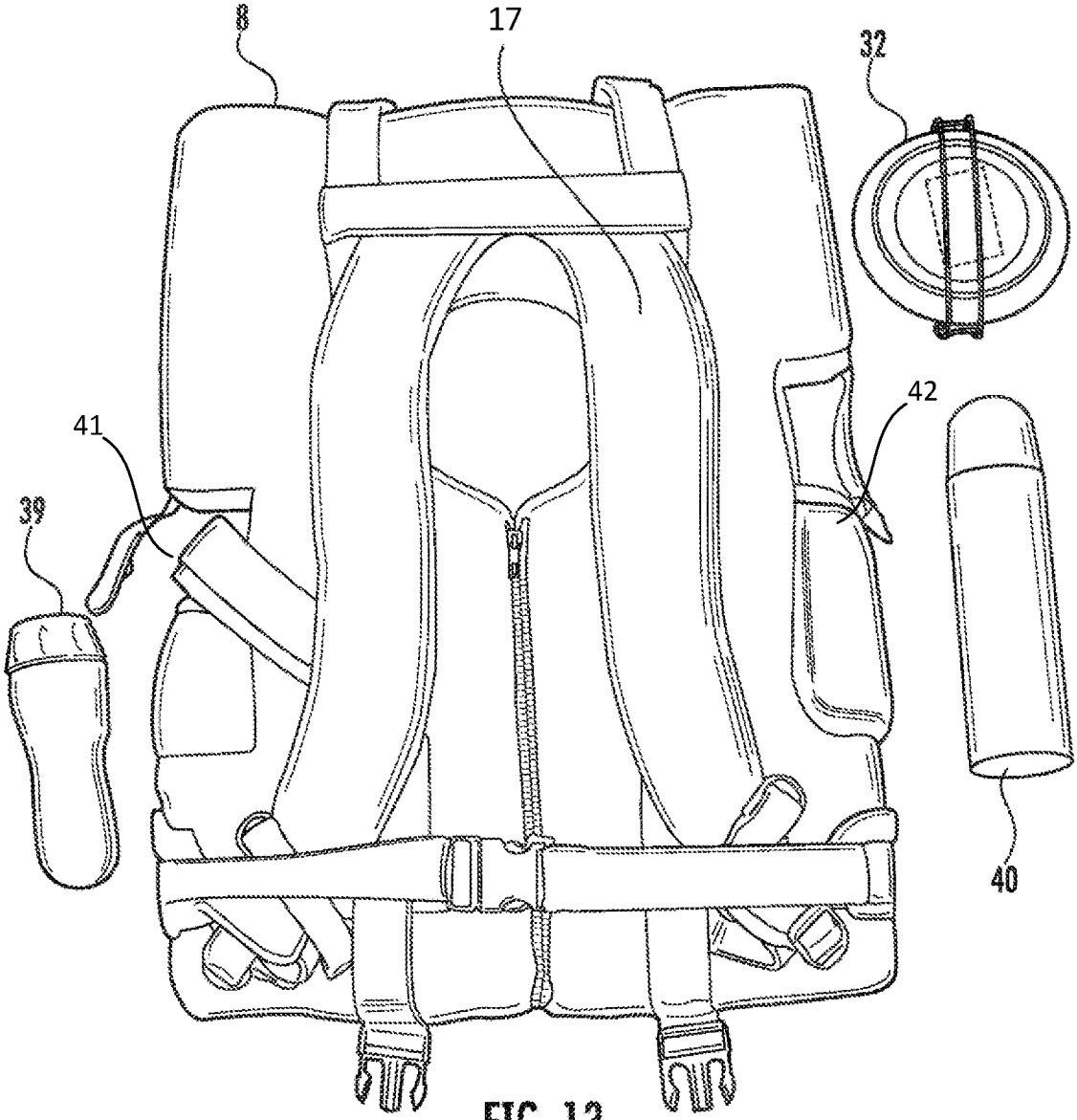
FIG. 13 substantially shows a life jacket storing additional survival items.

FIG. 13 shows the an emergency mess container (32) which attaches to snaps of lifejacket/backpack-vest (8) head-hole area when vest is not in use. The emergency mess container (32) serves as a multi-purpose tool; it contains emergency supplies inside, used for cooking pot, drinking cup and many other tool functions. Flashlight (39) and drink thermos (40) is shown by their respective storage pockets areas (41, 42) of lifejacket/backpack-vest.

Figure 14:
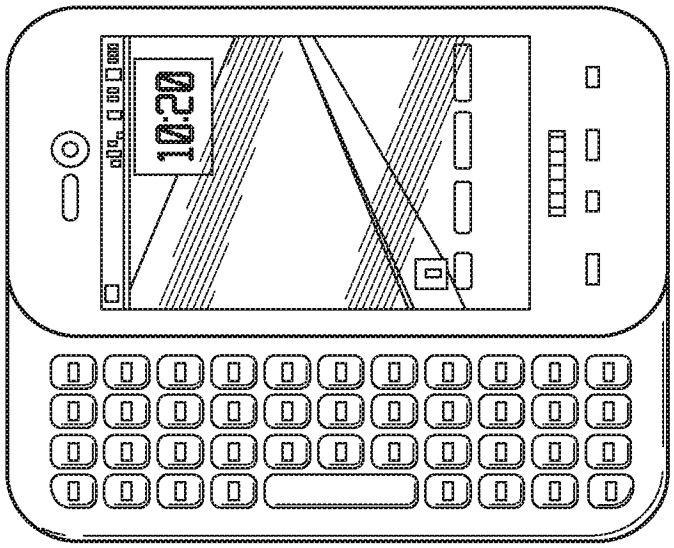
FIG. 14 substantially shows mobile communications elements of a survival package.
Figure 14:
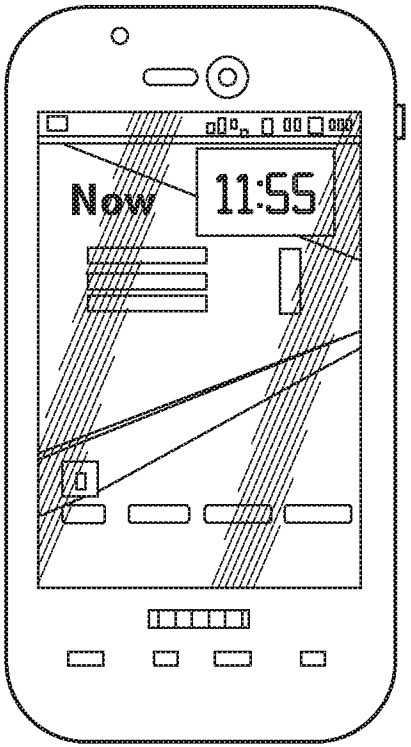

FIG. 14 shows a mobile device, (wireless cell phone) in this illustration used for communication, Global Positioning System (GPS) navigation and other Mobile-Heath special disaster/emergency software applications; such as Emergency Response System Helpline and more.

Digital technology can be important for disaster survival. First, it enables a fast way for survivors to communicate the location, situation and circumstance they find themselves in to rescue personnel and other survivors irrespective of time and place. Thus, communications capability it allows the survivor(s) to be valuable contributors of first hand information, not just passive disaster victims. Secondly, it acts as an effective retrieval tool for accessible, accurate and timely disaster information; and also as fast way for a user under stress to retrieve and forward vital personal data.

Figure 15A:
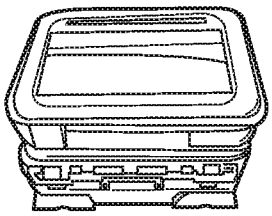
FIG. 15A substantially shows how the user receives the complete survival unit package.
Figure 15B:
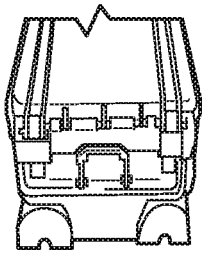
FIG. 15B shows the package of FIG. 15A with the top case removed.
Figure 15C:
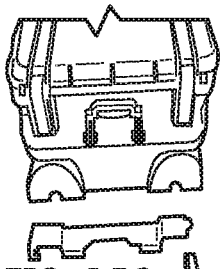
FIG. 15C shows the package of FIG. 15B with the case security Bar and Transportation Security Administration (TSA) Lock removed.
Figure 15D:
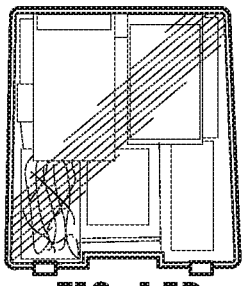
FIG. 15D substantially shows the package of 15C with a Supply Box located in the first compartment removed.
Figure 15E:
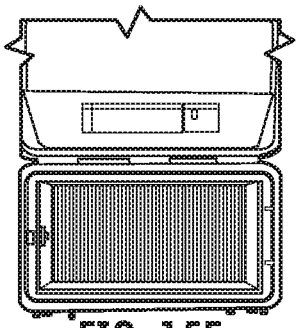
FIG. 15E substantially shows the first compartment is emptied of any supplies.
Figure 15F:
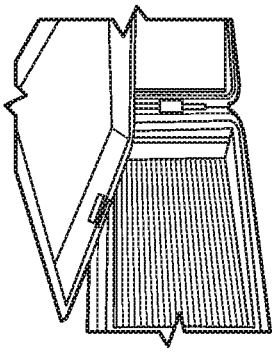
FIG. 15F substantially shows the first compartment when the Solar Lid is lifted on its narrow end and swiveled into an open position.
Figure 15G:
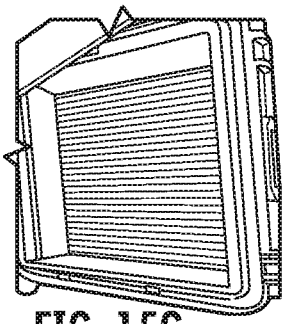
FIG. 15G substantially shows Solar Shelves inserted into one or more racking positions of the first compartment.
Figure 15H:
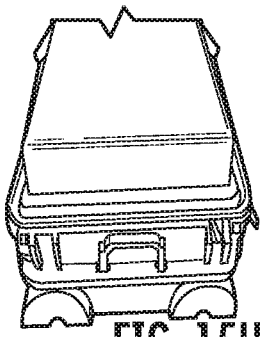
FIG. 15H substantially shows the Solar Lid closed after Food, Water and or other items are placed in the compartment.
Figure 15I:
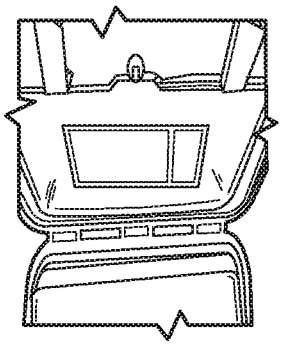
FIG. 15I substantially shows the Case Lid is in an open position with the Solar Mirror attached to inside of Lid and with detent stow lock.
Figure 15J:
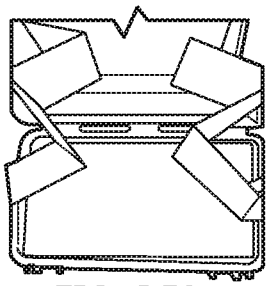
FIG. 15J substantially shows the Solar Mirrors are hinged together and attached to Case Lid being unfolded.
Figure 15K:
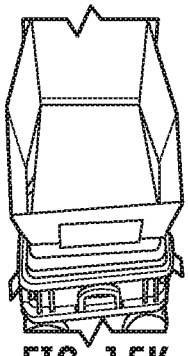
FIG. 15K substantially shows the Solar Mirrors in a cooking position.
Figure 15L:
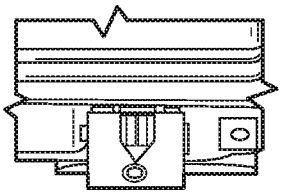
FIG. 15L substantially shows a Solar Angle Finder attached to an outside of the Case for maximum sun ray position degree.
Figure 15M:
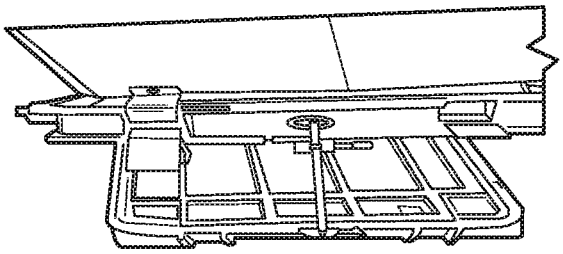
FIG. 15M substantially shows a Solar Angle Rod and Slide Lock to set case at maximum sun ray position degree.
Figure 15N:
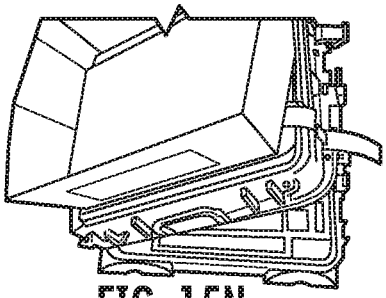
FIG. 15N substantially shows the Solar Cooking Unit in functioning mode.

A communications module in accordance with an embodiment of the present invention provides a cell phone or at least wireless communication capability, together with appropriate software applications. Such applications may provide one or more of the following functions:

- Emergency Response Systems-Helpline
- Education, Training and Awareness
- GPS-navigation. Where you are, Want to go, Shelter locations, Supply Locations/Costs
- Remote Diagnostics
- User Information-personal profile, emergency contacts, vehicle info., financial info, documents, medication, and more
- Patient Monitoring Devices
- Telemedicine
- Environmental Conditions-air pollution FIG. 15 show how the solar cooking unit is set-up for use. FIG. 15A, shows how the user receives the complete survival unit. In FIG. 15B, the top case is removed. In FIG. 15C, the case security Bar and TSA Lock is removed. FIG. 15D d, a Supply Box located in the first compartment is removed. In FIG. 15E, the first compartment is emptied of any other supplies. In FIG. 15F, the Solar Lid is lifted on its narrow end and swiveled into an open position. In FIG. 15G, Solar Shelves are inserted into one or more racking positions. In FIG. 15H, Food, Water and or other items are placed in the compartment and the Solar Lid is closed. In FIG. 15I, the Case Lid is in an open position with the Solar Mirror attached to inside of Lid and with detent stow lock. In FIG. 15J, Solar Mirrors are hinged together and attached to Case Lid being unfolded. In FIG. 15K, Solar Mirrors in cooking position. In FIG. 15L, Solar Angle Finder attached to outside of Case for maximum sun ray position degree. In FIG. 15M, Solar Angle Rod and Slide Lock to set case at maximum sun ray position degree. FIG. 15N shows the Solar Cooking Unit in functioning mode.

Figure 16:
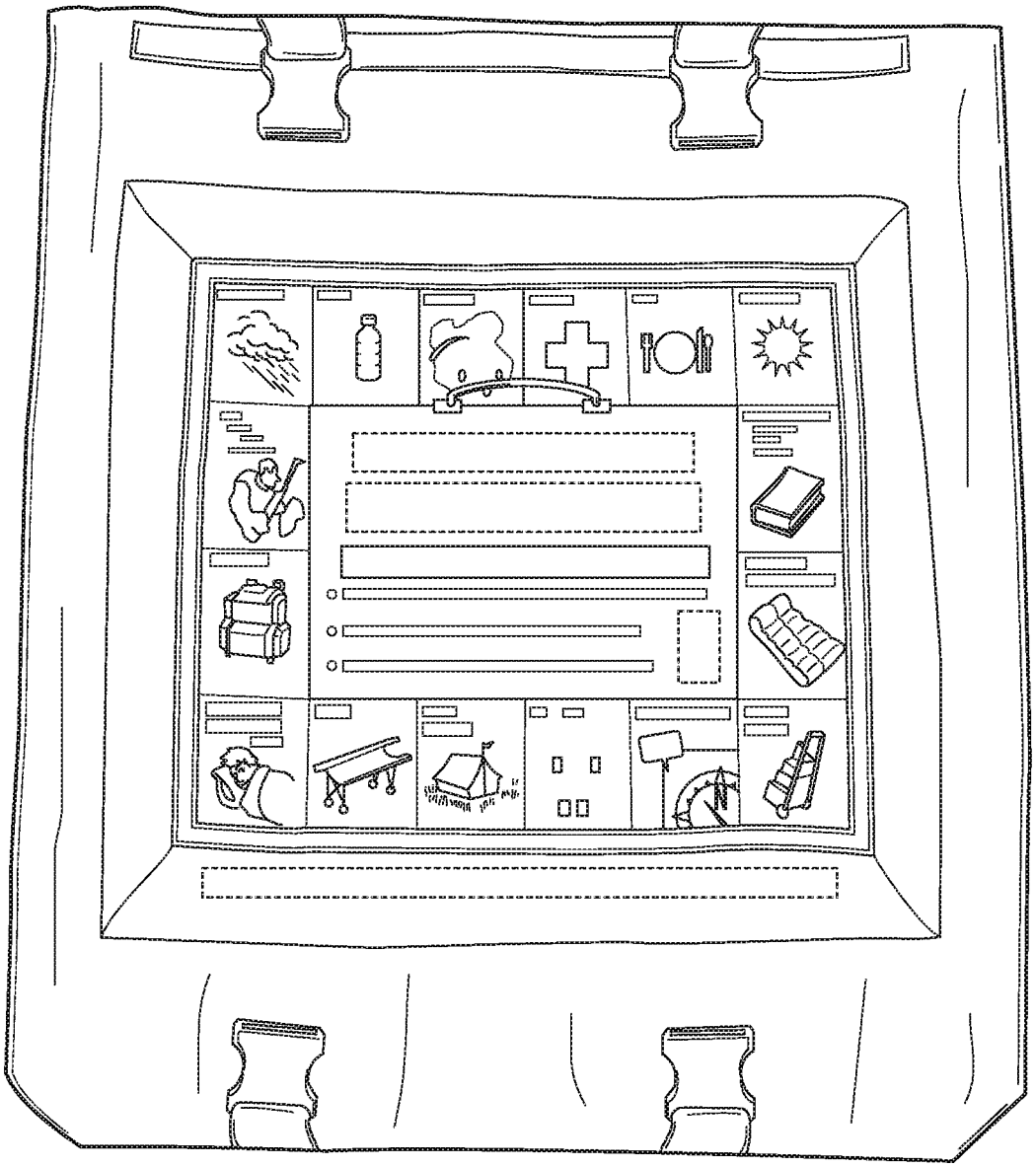
FIG. 16 substantially shows a clip on storage bag.

FIG. 16 is a view of the Clip on Storage Bag which attaches to the Lifejacket/backpack-vest.

Figure 17:
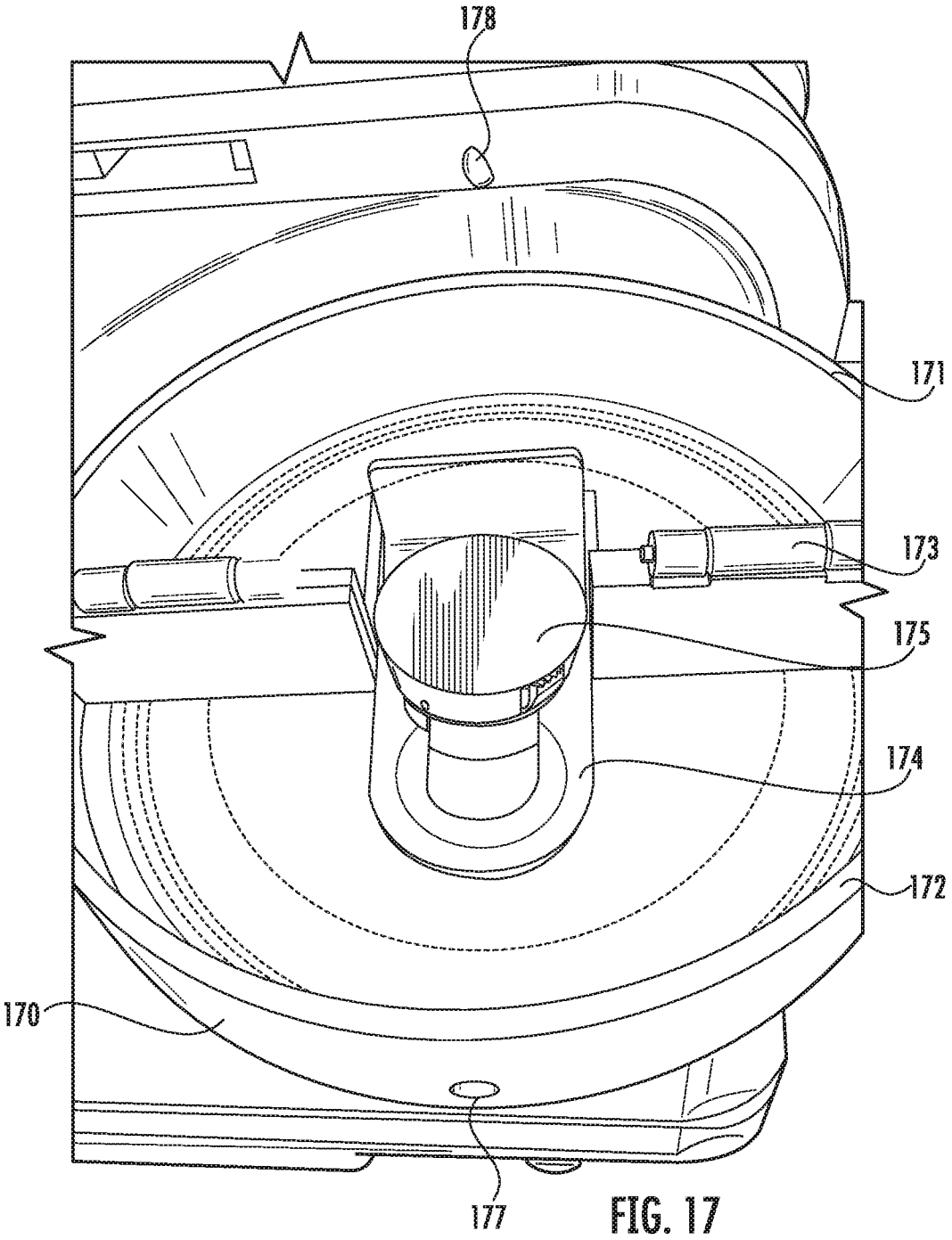
FIG. 17 substantially shows a folding wheel in a deployed (rolling) configuration.
Figure 18:
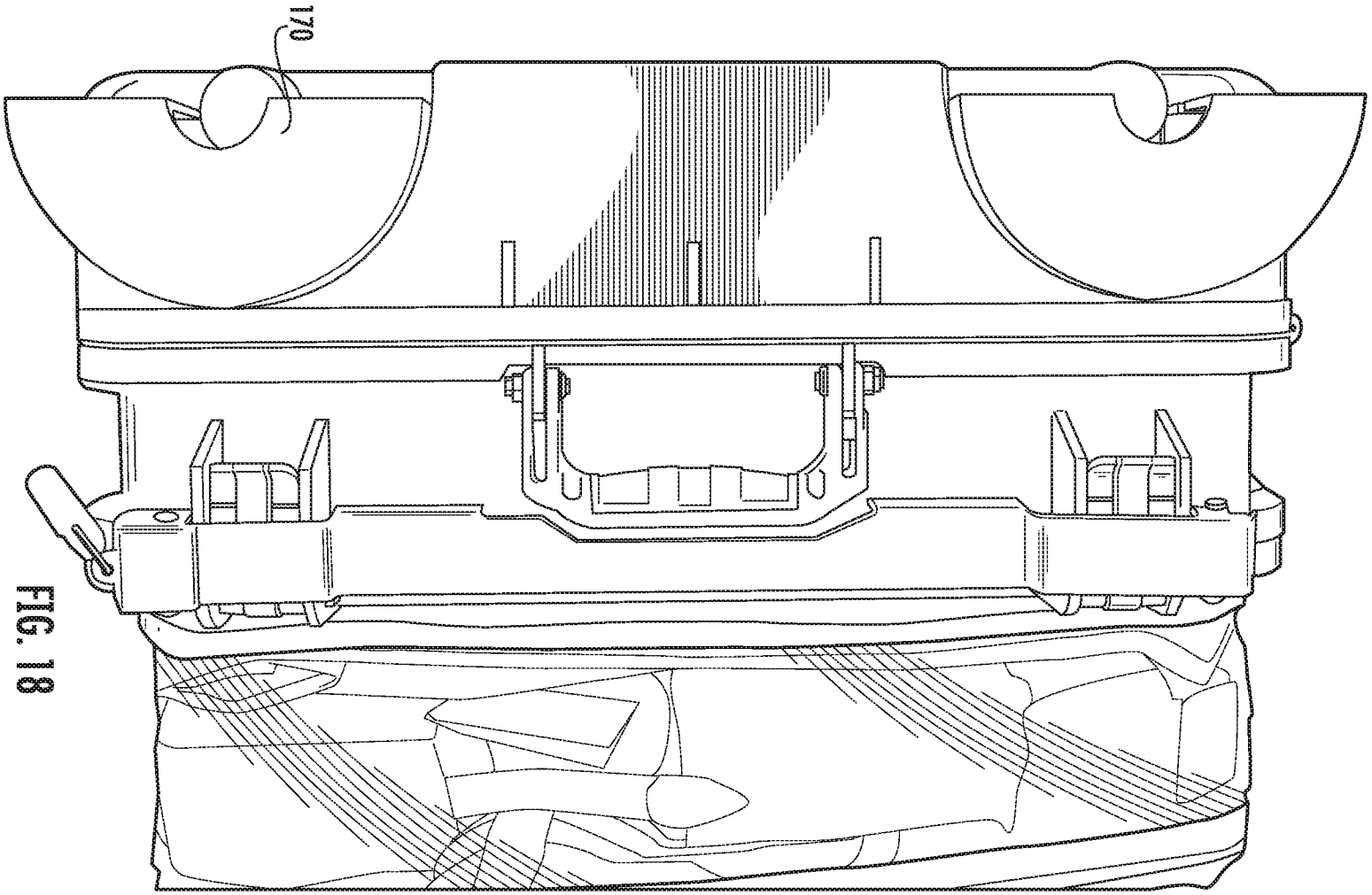
FIG. 18 substantially shows the folding wheel in a folded configuration.

FIGS. 17 and 18 shown an alternative embodiment featuring an alternative wheel arrangement. In this arrangement, the wheels are flip wheels comprising two halves that are hinged together. FIG. 17 shows the wheel 170 comprising two halves 171, 172 that are hinged together by hinge 173. A sliding lock bracket 174 locks the wheel in the unfolded deployed (rolling) position as shown in FIG. 17. The lock bracket 174 cooperates with an axle 175 that mounts the wheel 170 for rotation to the casing. FIG. 18 shows the wheel 170 in the folded position such that when the casing is resting on the ground, the wheel is not in contact with the ground. There is a hole 177 in the rim of the folding part of the wheel. A nipple 178 on the case engages the hole to lock the folding portion in a folded position.

Figure 19A:
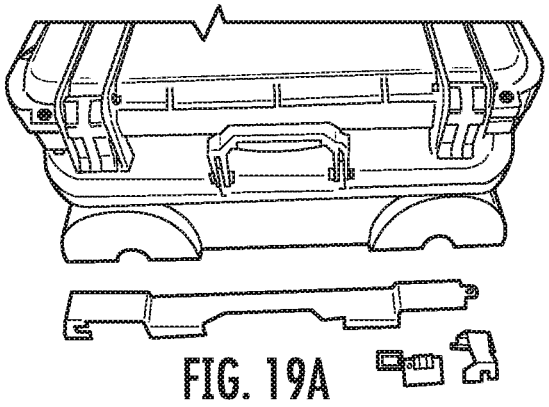
FIG. 19A substantially shows the components for a locking bar in disassembled configuration.
Figure 19B:
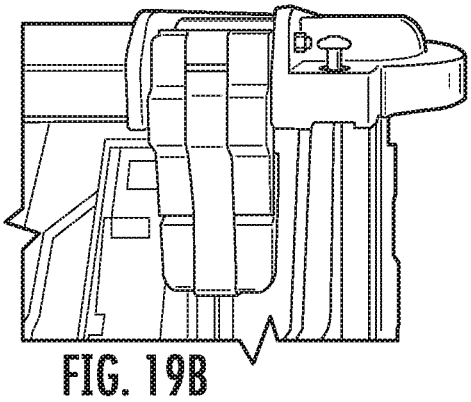
FIG. 19B substantially shows a pin/screw on a front corner of the casing.
Figure 19C:
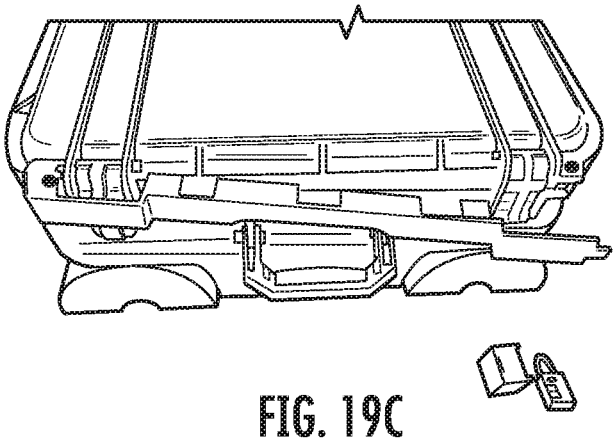
FIG. 19C substantially shows the locking bar engaging a left side pin.

FIGS. 19A-19E show a locking bar arrangement for locking the case closed. To engage the locking bar, there is a pin/screw or similar on two front corners of the casing (FIG. 19B). The bar is placed on the casing first with a slot on the slot side of the bar that engages the left side pin (FIG. 19C). There are tabs that abut the top and bottom of the flange on the casing that keep the casing from being opened. The bar is contoured to closely cover the front of the casing. The bar also covers the latches and prevent them from being opened. The bar may be made from steel or other rigid material.

Figure 19D:
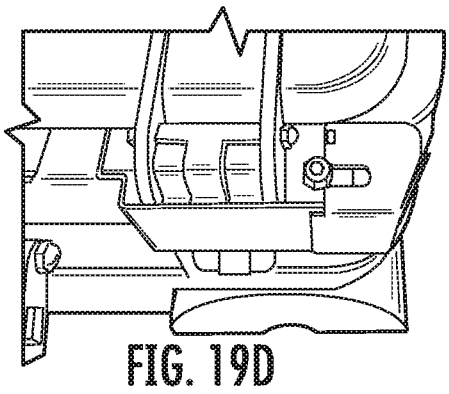
FIG. 19D substantially shows an end cap of the locking bar.
Figure 19E:
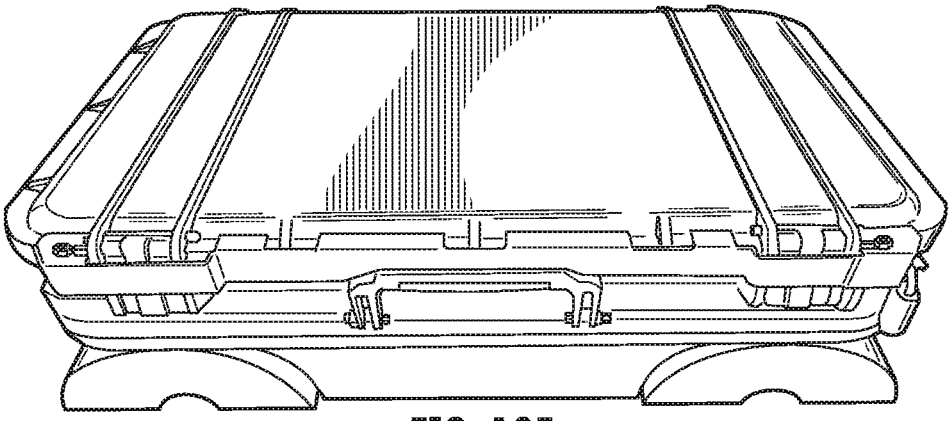
FIG. 19E substantially shows the casing with the locking bar installed.

A right end cap covers the right side of the bar and the right cover of the casing (FIG. 19D). A slot engages the pin on the right side of the box. There is a slot on the end cap that receives a locking tab from the bar. The locking tab has a hole for receiving a locking device, such as a pad lock, TSA lock, etc. The lock prevents removal of the end cap.

Although the description above contains many specifications, these should not be construed as limiting the scope of the invention but as merely providing illustrations of some of the embodiments of this invention. Thus, the scope of the invention should be determined by the appended claims and their legal equivalents rather than by the examples given.

What is claimed is:

1. A survival package comprising:

(A) a casing that is openable to reveal:

(a) a first compartment providing a first storage section; and (b) a second compartment providing a second storage section; wherein when the casing is in an open position, the first compartment can be disposed adjacent the second compartment such that the first compartment and the second compartment cooperate to form a platform comprising a platform surface;

(B) a tent that has a storage location in at least one of the first storage section or the second storage section, wherein the tent can be removed from the storage location and fitted to the platform to create a tent shelter; and (C) one or more wheels;

(D) a life jacket fitted to the casing, wherein the life jacket can be disposed adjacent to the platform to extend the platform surface;

(E) wherein when the casing is in a closed position, the casing is able to be transported by rolling on the wheels.

2. The survival package of claim 1 comprising a tent pole that is stored in at least one of the first storage section or the second storage section, wherein the tent pole can be disposed on the platform to provide support to the tent.

3. The survival package of claim 1 wherein the life jacket is fitted to the casing such that the casing can be worn on the back of the user via the life jacket.

4. The survival package of claim 1 wherein the first compartment is hinged to the second compartment.

5. The survival package of claim 4 wherein the first compartment is removable from the second compartment such that the first compartment and the second compartment can be carried individually.

6. The survival package of claim 1 wherein each of the first compartment and the second compartment comprise a padded platform surface.

7. The survival package of claim 1 wherein the one or more wheels are retractable at least partially into the casing.

8. The survival package of claim 1 wherein the one or more wheels are flip wheels comprising two halves that are hinged together.

9. The survival package of claim 1 comprising a retractable handle that retractably extends from the casing to allow the casing to be towed.

10. The survival package of claim 9 wherein the handle is fully removable from the casing and comprises one or more tools.

11. The survival package of claim 10 wherein the one or more tools comprise a saw.

12. A survival package comprising:

(A) a first compartment providing a first storage section;

(B) a second compartment providing a second storage section;

(C) tent means for providing a tent shelter;

(D) flip wheel means for allowing wheeled transport of the survival package;

(E) life jacket means for providing a life jacket to a user, (F) wherein the second compartment is joinable to the first compartment to form casing means;

(G) wherein the first compartment and second compartment can be located adjacent each other to form platform means and the life jacket means locatable adjacent the platform means to extend the platform means and wherein the tent means can be fitted to the platform means to form tent shelter means for sheltering a person.

13. The survival package of claim 12 comprising pole means for supporting the tent means, the pole means storable in at least one of the first compartment or second compartment.

14. The survival package of claim 12 comprising handle means for pulling the survival package, the handle means being removable from the casing means, the handle means comprising one or more tools.

15. A survival package comprising:

(A) a casing that is openable to reveal:

(a) a first compartment providing a first storage section; and (b) a second compartment providing a second storage section; wherein when the casing is in an open position, the first compartment can be disposed adjacent the second compartment such that the first compartment and the second compartment cooperate to form a platform comprising a platform surface;

(B) a tent that has a storage location in at least one of the first storage section or the second storage section, wherein the tent can be removed from the storage location and fitted to the platform to create a tent shelter; and (C) a life jacket fitted to the casing, wherein the life jacket can be disposed adjacent to the platform to extend the platform surface;

(D) wherein when the casing is in a closed position, the casing is able to be transported.

16. The survival package of claim 15 wherein the life jacket is fitted to the casing such that the casing can be worn on the back of the user via the life jacket.

17. A survival package comprising:

(A) a casing that is openable to reveal:

(a) a first compartment providing a first storage section; and (b) a second compartment providing a second storage section; wherein when the casing is in an open position, the first compartment can be disposed adjacent the second compartment such that the first compartment and the second compartment cooperate to form a platform comprising a platform surface;

(B) a tent that has a storage location in at least one of the first storage section or the second storage section, wherein the tent can be removed from the storage location and fitted to the platform to create a tent shelter; and (C) a retractable handle that retractably extends from the casing to allow the casing to be towed, wherein the handle is fully removable from the casing and comprises one or more tools comprising at least a saw;

(D) wherein when the casing is in a closed position, the casing is able to be transported.

18. A survival package comprising:

(A) a casing that is openable to reveal:

(a) a first compartment providing a first storage section; and (b) a second compartment providing a second storage section; wherein when the casing is in an open position, the first compartment can be disposed adjacent the second compartment such that the first compartment and the second compartment cooperate to form a platform comprising a platform surface;

(B) a tent that has a storage location in at least one of the first storage section or the second storage section, wherein the tent can be removed from the storage location and fitted to the platform to create a tent shelter; and (C) one or more wheels, wherein the one or more wheels are flip wheels comprising two halves that are hinged together;

(D) wherein when the casing is in a closed position, the casing is able to be transported by rolling on the wheels.

* * * * *